US006405898B1

(12) United States Patent
O'Connor et al.

(10) Patent No.: US 6,405,898 B1
(45) Date of Patent: Jun. 18, 2002

(54) DISPENSER FOR A FOAMING PRODUCT

(75) Inventors: William T. O'Connor, Londonderry, NH (US); David M. Groh, Marshfield, MA (US); Timothy Wheatley, Beverly, MA (US); Norman D. Poisson, Andover, MA (US); Steven M. Bourque, Bradford, MA (US); Henry D. Ren, Tyngsboro, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/713,918

(22) Filed: Nov. 16, 2000

(51) Int. Cl.[7] ..... B65D 83/14

(52) U.S. Cl. ..... 222/108; 222/148; 222/402.12; 222/402.13; 222/517; 222/571

(58) Field of Search ..... 222/108, 571, 222/402.1, 402.13, 402.12, 505, 517, 182, 148, 380, 207; 219/214

(56) References Cited

U.S. PATENT DOCUMENTS

| | | | | |
|---|---|---|---|---|
| 1,456,408 A | | 5/1923 | Scherer | 222/564 |
| 3,154,224 A | * | 10/1964 | Wakeman | 222/402.12 |
| 3,292,823 A | | 12/1966 | Weidman et al. | 222/146.3 |
| 3,305,179 A | | 2/1967 | Lehmann | 239/337 |
| 3,312,723 A | | 4/1967 | Anderson et al. | 222/402.13 |
| 3,318,488 A | | 5/1967 | Barnes | 222/182 |
| 3,323,695 A | * | 6/1967 | Monahon | 222/506 |
| 3,373,904 A | | 3/1968 | Lowry | 222/146.3 |
| 3,377,005 A | * | 4/1968 | Marder | 222/402.13 |
| 3,399,810 A | | 9/1968 | Burne | 222/146.3 |
| 3,493,720 A | | 2/1970 | Francis | 219/214 |
| 3,540,624 A | * | 11/1970 | Green | 222/108 |
| 3,628,702 A | | 12/1971 | Kimura | 222/402.13 |
| 3,642,179 A | * | 2/1972 | Micallef | 222/402.12 |
| 3,785,528 A | * | 1/1974 | Mandeltort | 222/148 |
| 3,917,121 A | | 11/1975 | Claffone | 222/146.3 |
| 4,132,333 A | | 1/1979 | Debard | 222/402.13 |
| 4,901,891 A | * | 2/1990 | Goncalves | 222/402.13 |
| 4,978,035 A | | 12/1990 | Morane et al. | 222/108 |
| 5,027,982 A | | 7/1991 | Demarest | 222/182 |
| 5,137,180 A | * | 8/1992 | Kieras | 222/108 |
| 5,205,441 A | * | 4/1993 | Andris | 222/207 |
| 5,232,127 A | | 8/1993 | Trotta et al. | 222/108 |
| 5,732,855 A | * | 3/1998 | van der Heijden | 222/402.12 |

FOREIGN PATENT DOCUMENTS

| | | |
|---|---|---|
| CA | 973848 | 9/1975 |
| DE | 26 33 899 A1 | 2/1977 |
| EP | 0 370 842 A1 | 5/1990 |
| FR | 1190196 | 10/1959 |
| FR | 2252876 | 6/1975 |
| FR | 2333706 | 7/1977 |
| FR | 2394466 | 1/1979 |
| GB | 1057353 | 2/1967 |
| WO | WO 83/00134 | 1/1983 |

* cited by examiner

*Primary Examiner*—William C. Doerrler
*Assistant Examiner*—Patrick Buechner
(74) *Attorney, Agent, or Firm*—Fish & Richardson P.C.

(57) ABSTRACT

The invention features, in general, a foaming product that includes a container, a valve stem extending upward from the top of the container, a nozzle member, and a waste product containment region located above the top of the container. The valve stem is movable downward to permit discharge of the foaming product from the container through the stem. The nozzle member includes a flow passage for directing the foaming product from the top of the valve stem to a discharge outlet and a movable portion that is movable between a discharge position and an inactive position. When the movable portion is in the discharge position, the valve stem is actuated to permit discharge of product into the flow passage and out of the discharge outlet, and the flow passage does not communicate with the containment region. When the movable portion is in the inactive position, the valve is not actuated, and the flow passage communicates with the waste product containment region such that undischarged foaming product in the flow channel is directed to the waste product containment region.

17 Claims, 7 Drawing Sheets

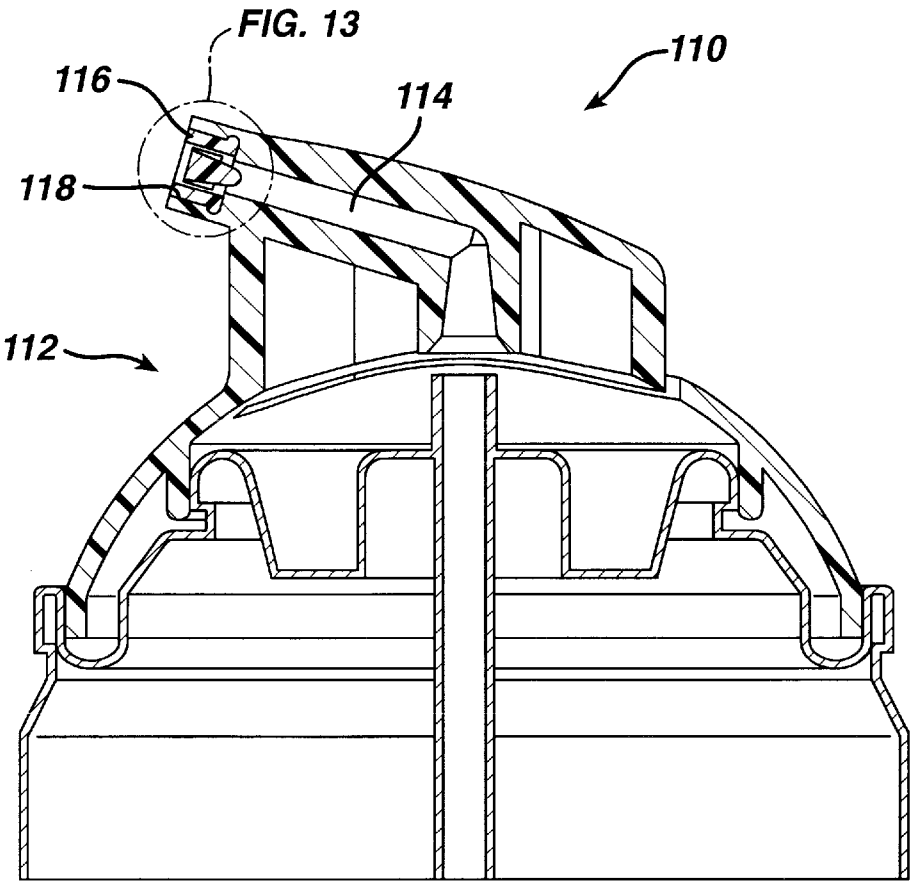
FIG. 12
FIG. 13
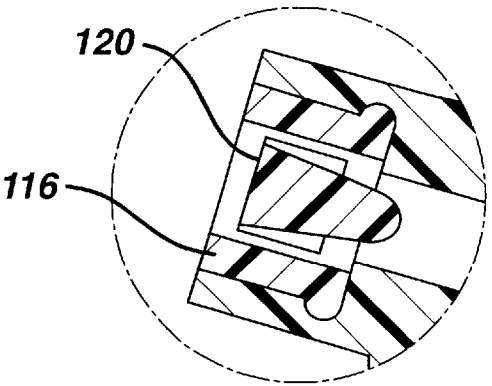

DISPENSER FOR A FOAMING PRODUCT

BACKGROUND OF THE INVENTION

The invention relates to a dispenser for a foaming product.

After foaming products have been dispensed from a container, continued expansion of the product in a delivery conduit can cause the product to drool out of the discharge outlet.

Trotta U.S. Pat. No. 5,232,127 describes avoiding unwanted build-up of foamed product that continues to expand in and be discharged from a delivery conduit in a nozzle of a pressurized can after the valve has been turned off by using a cap that has an opening to permit uninhibited venting of gas entrained in the product in the conduit and entry of drying air to dry the product that has drooled from the nozzle after turning off the valve.

Ciaffone U.S. Pat. No. 3,917,121 describes providing an upwardly directed baffle in a discharge region to cause post-discharge foam to flow along the bottom surface of the baffle into a retraction chamber.

SUMMARY OF THE INVENTION

The invention features, in general, a foaming product that includes a container, a valve stem extending upward from the top of the container, a nozzle member, and a waste product containment region located above the top of the container. The valve stem is movable downward to permit discharge of the foaming product from the container through the stem. The nozzle member includes a flow passage for directing the foaming product from the top of the valve stem to a discharge outlet and a movable portion that is movable between a discharge position and an inactive position. When the movable portion is in the discharge position, the valve stem is actuated to permit discharge of product into the flow passage and out of the discharge outlet, and the flow passage does not communicate with the containment region. When the movable portion is in the inactive position, the valve is not actuated, and the flow passage communicates with the waste product containment region such that undischarged foaming product in the flow channel is directed to the waste product containment region.

Preferred embodiments of the invention may include one or more of the following features. In preferred embodiments the container is a pressurized can. The containment region is a substantially enclosed chamber. The dispenser includes a discharge shut-off structure that provides a waste flow path from the discharge outlet to the waste product containment region when the movable portion of the nozzle member is in the inactive position and permits the discharge outlet to discharge the foaming product when the movable portion of the nozzle member is in the discharge position. The shut-off structure can be stationary with respect to the container, and movement of the movable portion of the nozzle member from the discharge position to the inactive position causes the discharge outlet to be moved from a position outside of the waste flow path to a position where it communicates with the waste flow path. The movable portion of the nozzle member can be pivotally connected to the shut-off structure. The discharge shut off structure can wipe the discharge outlet as the movable portion moves from the inactive position to the discharge position.

The nozzle member can have a base portion that is connected to the container, and the movable portion can be pivotally connected to the base portion. A waste containment region can be located within the base portion underneath the movable portion.

In some preferred embodiments the flow passage includes a flow restriction that the foaming product overcomes when the valve stem is in the discharge position, and there is a waste flow diverter path from the flow passage to the waste product containment region when the movable portion of the nozzle member is in the inactive position, the waste flow diverter path having less flow resistance than the flow restriction when the movable portion of the nozzle member is in the inactive position so as to direct the undischarged foaming product to the waste product containment region, the waste product not overcoming the flow restriction when the movable portion is in the inactive position. The waste flow diverter path can be provided by a gap between the nozzle inlet and the top end of the valve stem when the movable portion of the nozzle member is in the inactive position, the nozzle inlet contacting a top end of the valve stem when the movable portion of the nozzle member is in the discharge position. The movable portion can be spring-biased to the inactive position. The flow restriction can be provided by a reduction in channel cross-sectional area of a flow passage in going from the nozzle inlet to the discharge outlet. Alternatively the flow restriction can be provided by a restricted area in the flow passage at the discharge outlet, e.g. the flow restriction can be provided by an insert placed in a flow passage at the discharge outlet.

The movable portion can be connected to the base portion by an integrally formed hinge between the base portion and the movable portion. The hinge can bias the movable portion to the inactive position. The movable portion can include first and second moving portions, the first moving portion having a flow passage therethrough and the discharge outlet thereon, the second moving portion being movably mounted with respect to the first portion such that the second portion closes the discharge outlet when movable portion is in the inactive position, and opens a discharge outlet when the movable portion is in the discharge position.

The waste product containment region can communicate with a chamber having a variable size, the chamber being operably connected to the nozzle member to have a decreased volume when the movable portion of the nozzle member is in the discharge position and an increased volume when the movable portion is in the inactive position. A decrease in pressure in the chamber (resulting from chamber expansion) is communicated to the flow passage to cause the waste product to flow from the discharge outlet and toward the waste product containment region after the valve has closed and the movable portion of the nozzle member has moved to the inactive position. The chamber can include a bellows. The nozzle member can include a guide member secured to the top of the can, and the nozzle member can have an extension that is telescoping with respect to the guide member as the movable portion of a nozzle member moves between the discharge position and the inactive position. The chamber can be spring-biased to the expanded position. The bellows can provide the spring biasing or a separate spring can be used.

Embodiments of the invention may include one or more of the following advantages. Foam product that expands in a flow passage conduit after discharge is prevented from drooling out of the discharge outlet and is instead directed to a waste product containment region and/or held inside the passage.

Other features and advantages of the invention will be apparent from the following description of the preferred embodiments thereof and from the claims.

BRIEF DESCRIPTION OF THE DRAWINGS

FIG. 12 is a partial vertical sectional view of another embodiment of a dispenser for dispensing a foaming product in an inactive position.

FIG. 13 is an enlarged portion of the FIG. 12 dispenser.

DETAILED DESCRIPTION OF PARTICULAR EMBODIMENTS

Figure 2:
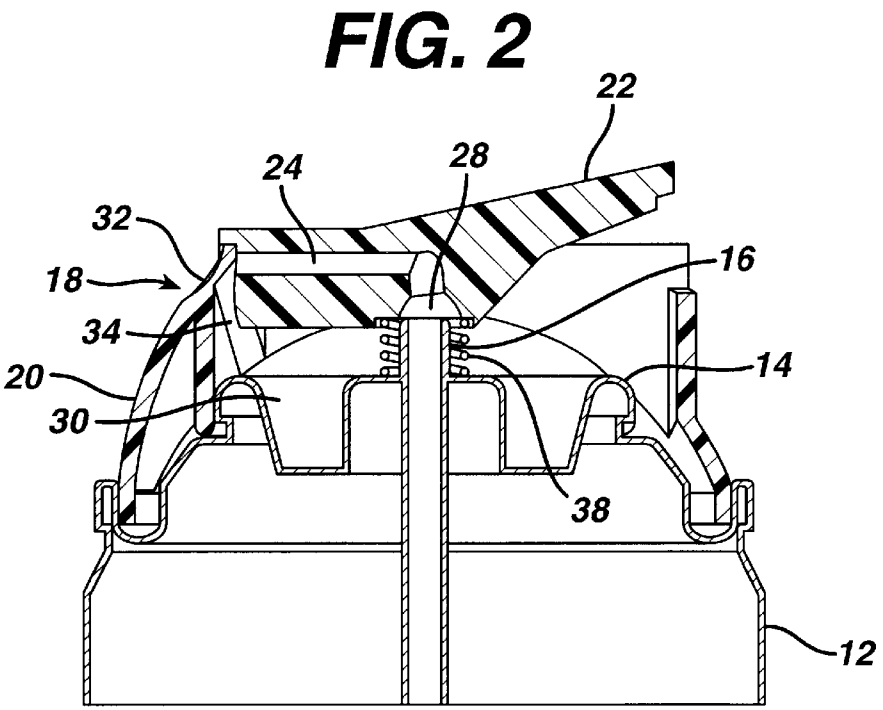
FIG. 2 is a partial vertical sectional view of the FIG. 1 dispenser in the inactive, closed position.
Figure 1:
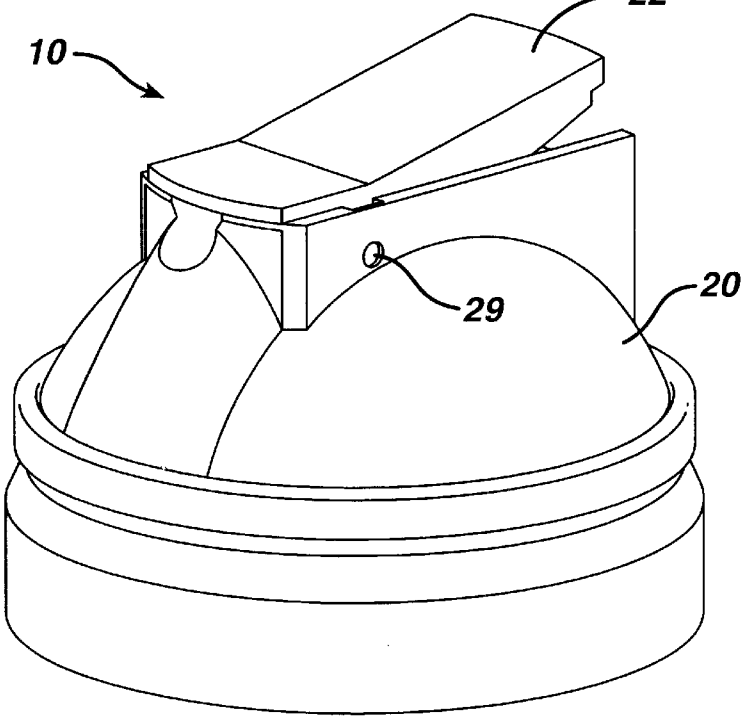
FIG. 1 is a partial perspective view of a dispenser for dispensing a foaming product in an inactive, closed position.
Figure 4:
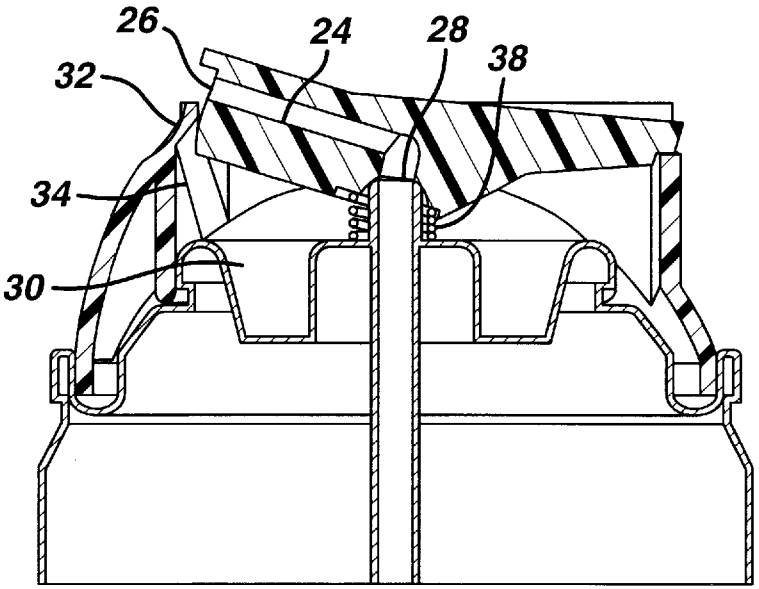
FIG. 4 is a partial vertical sectional view of the FIG. 1 dispenser in the discharge position.
Figure 3:
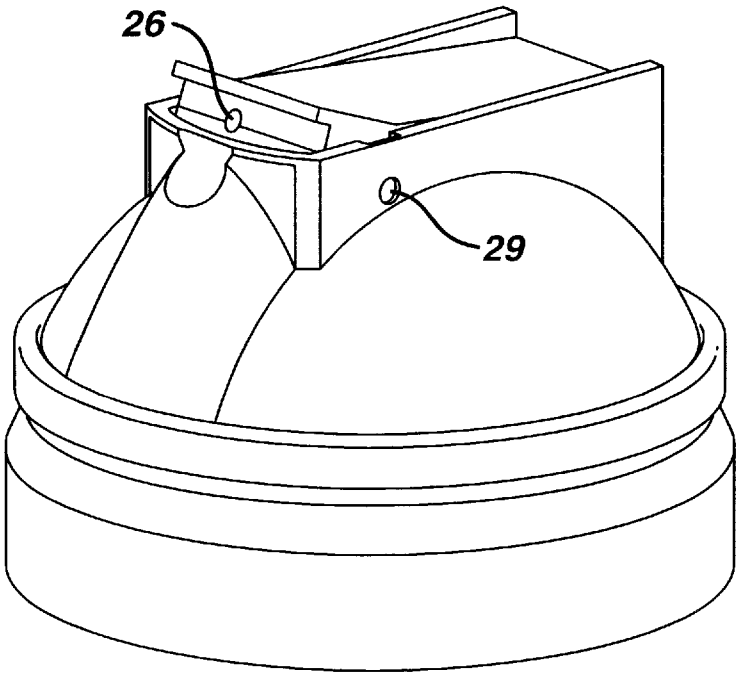
FIG. 3 is a partial perspective view of the FIG. 1 dispenser in the discharge position.

Referring to FIGS. 1–4, dispenser 10 for dispensing a foaming product includes pressurized can 12 having top 14, a valve (not shown) including valve stem 16, and nozzle member 18 including base portion 20 connected to top 14 and movable portion 22. Valve stem 16 extends from top 14 and is movable downward to permit discharge of the foaming product contained in can 12 through the stem 16. Movable portion 22 of the nozzle member includes flow passage 24 for directing foaming product from the top of valve stem 16 to discharge outlet 26 (FIGS. 3 and 4). Flow passage 24 has a nozzle inlet 28 that is shaped to provide a sealable connection to the top of valve stem 16 when movable portion 22 is depressed downward. Movable portion 22 is pivotally connected to base portion 20 at pivot 29. Dispenser 10 includes waste containment region 30 above top 14 and within nozzle member 18. The front part of base portion 20 includes a discharge shut off structure 32 that provides a waste flow path 34 from discharge outlet 26 to waste product containment region 30 in the inactive position shown in FIG. 2. Movable portion 22 is movable from the inactive position shown in FIGS. 1 and 2 to the discharge position shown in FIGS. 3 and 4. In the inactive position, the valve is not actuated, and flow passage 24 communicates with waste product containment region 30 such that undischarged foaming product in the flow channel is directed by waste flow path 34 to region 30. As movable portion 22 is moved downward, nozzle inlet 28 contacts the top of valve stem 16, and further downward movement of movable portion 22 causes valve stem 16 to be depressed and open the valve. In the discharge position shown in FIGS. 3 and 4, the valve is actuated to permit discharge of product into flow passage 24 and out of discharge outlet 26. Spring 38 biases movable portion 22 to the inactive position shown in FIGS. 1 and 2, permitting valve stem 16 to move upward to close the valve. As movable portion 22 pivots from the inactive position shown in FIG. 2 to the discharge position shown in FIG. 4, the top of shut off structure 32 acts to wipe the surface of the movable portion around discharge outlet 26.

Figure 6:
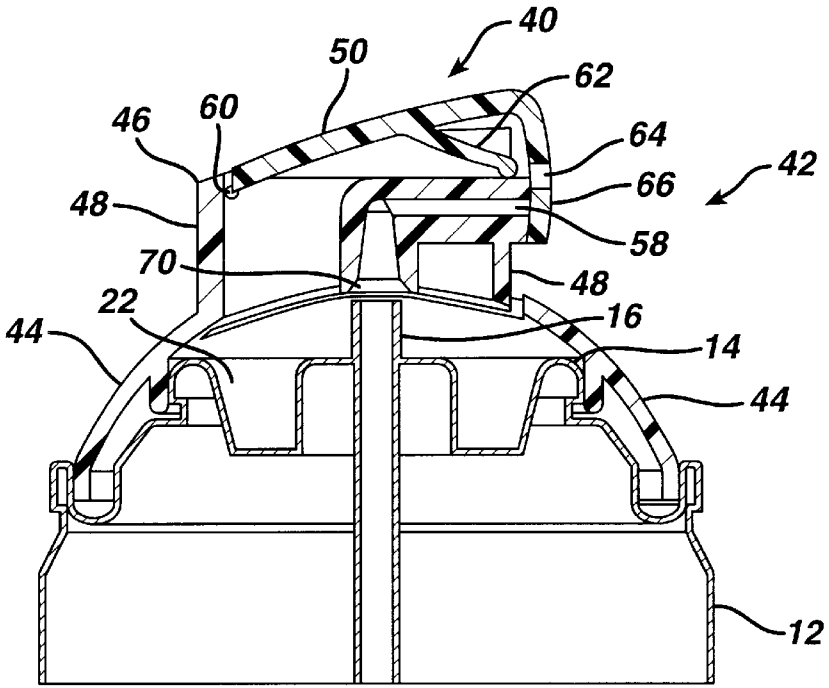
FIG. 6 is a partial vertical sectional view of the FIG. 5 dispenser in the inactive, closed position.
Figure 5:
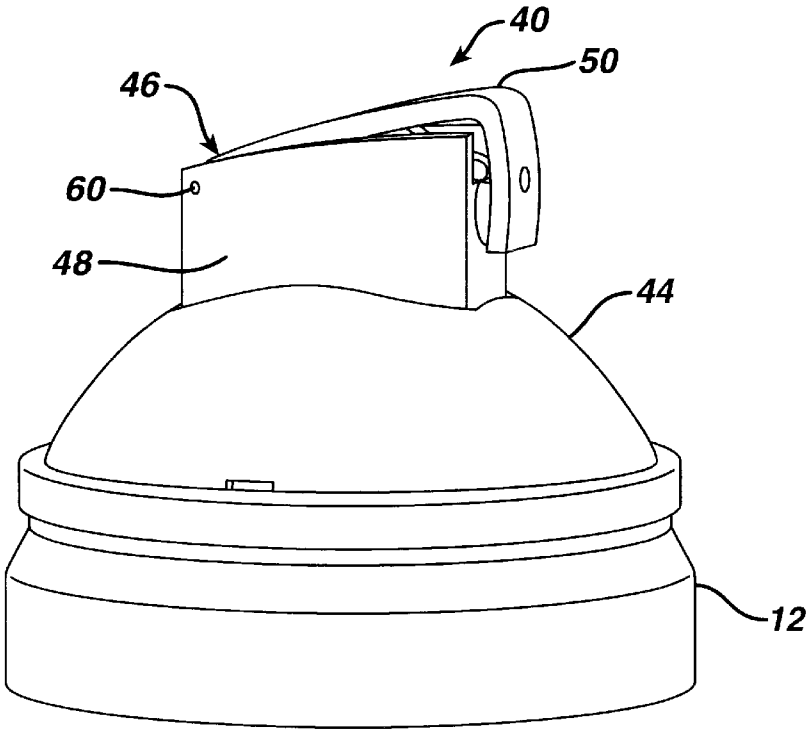
FIG. 5 is a partial perspective view of another embodiment of a dispenser for dispensing a foaming product in an inactive, closed position.
Figure 9:
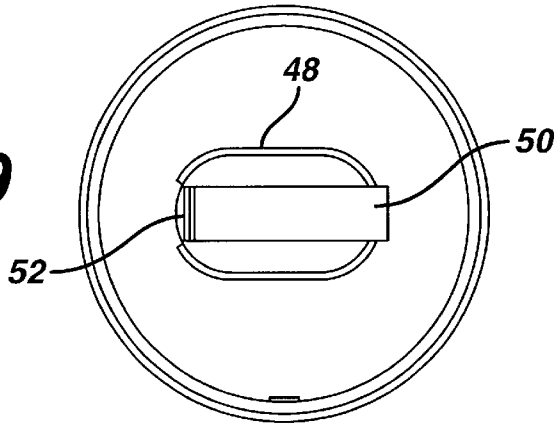
FIG. 9 is a top view of the FIG. 5 dispenser.
Figure 8:
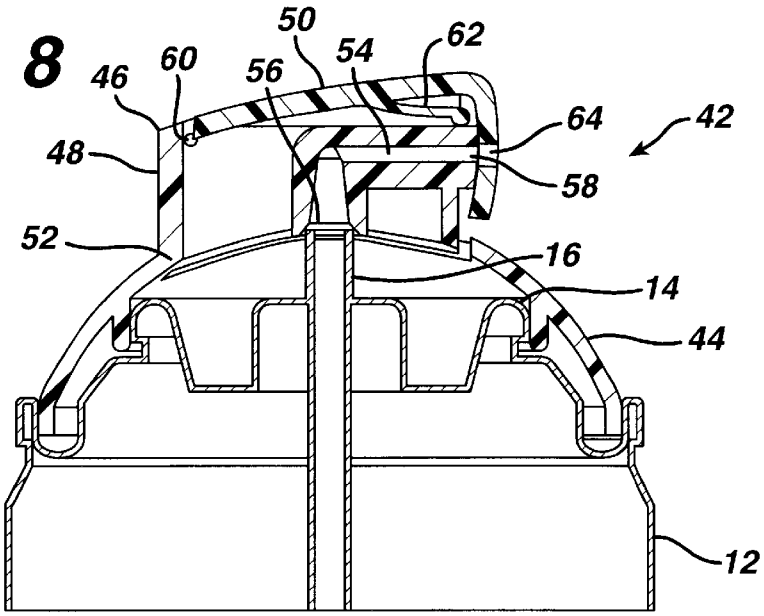
FIG. 8 is a partial vertical sectional view of the FIG. 5 dispenser in the discharge position.
Figure 7:
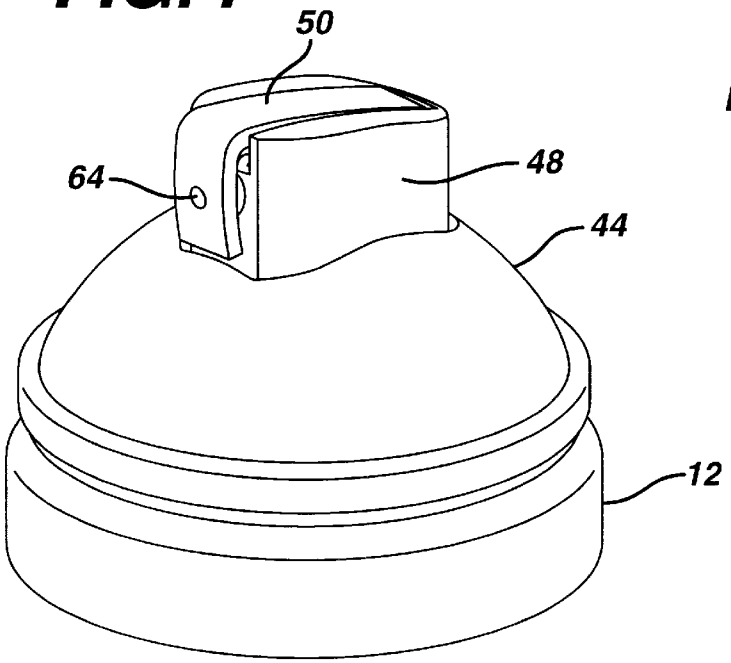
FIG. 7 is a partial perspective view of the FIG. 5 dispenser in the discharge position.

Referring to FIGS. 5–9, dispenser 40 for a foaming product is shown in a closed, inactive position in FIGS. 5 and 6 and in a discharge position in FIGS. 7 and 8. The nozzle member 42 includes a base portion 44 that snap fits to the top 14 of can 12 and a movable portion 46, which has first moving portion 48 and second moving portion 50. As is shown in FIG. 9, first portion 48 is connected to base portion 44 by an integral hinge 52. First portion 48 includes flow passage 54 extending from nozzle inlet 56 to discharge outlet 58. Second portion 50 is pivotally connected at pivot 60 to first portion 48. Second portion also has a spring flexure arm 62 that biases second portion 50 with respect to first portion 48 to the closed upward position shown in FIG. 6. Second portion 50 also has opening 64 that is aligned with discharge outlet 58 in the discharge position shown in FIG. 8. In the inactive position shown in FIG. 6, the lower end portion 66 blocks discharge outlet 58.

In use, when the user depresses second portion 50 relative to base portion 44, the second portion 50 first moves downward, and then first portion 48 moves downward with second portion 50 with respect to the top of valve stem 16 and creates a seal therewith at nozzle inlet 56, and further downward movement causes valve stem 16 to move downward and open the valve. When second portion 50 moves downward with respect to first portion 48, opening 64 aligns with discharge outlet 58 (FIG. 8). In the position shown in FIG. 8, the foaming product is discharged from can 14 through the valve stem 16 and flow passage 54 to discharge outlet 58 and aligned opening 64. When the user releases second portion 50, the first portion 48 moves upward, permitting valve stem 16 to move upward and to close the valve including valve stem 16. Second portion 50 moves upward with respect to first portion 48 such that the end portion 66 blocks discharge outlet 58. Any further expansion of the foaming product within flow passage 54 is then directed through gap 70 (FIG. 6) between the nozzle inlet 56 and the top of valve stem 16 into waste containment region 72.

Figure 11:
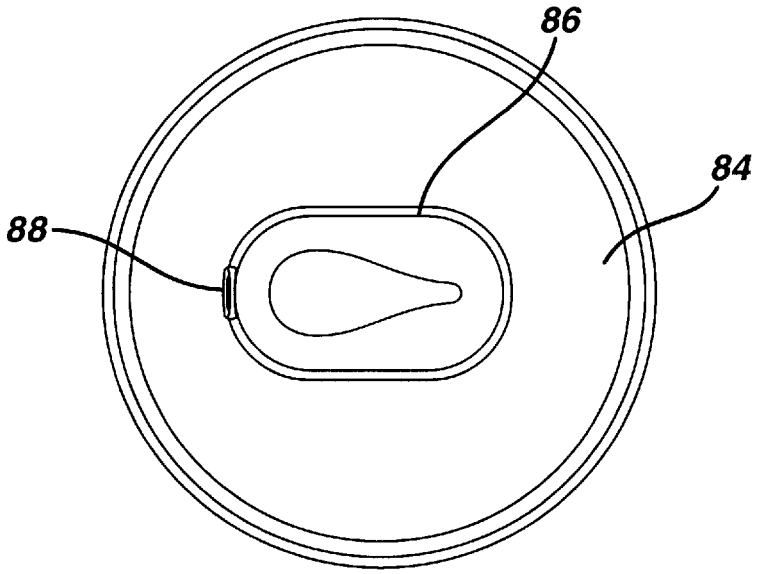
FIG. 11 is a top view of the FIG. 10 dispenser.
Figure 10:
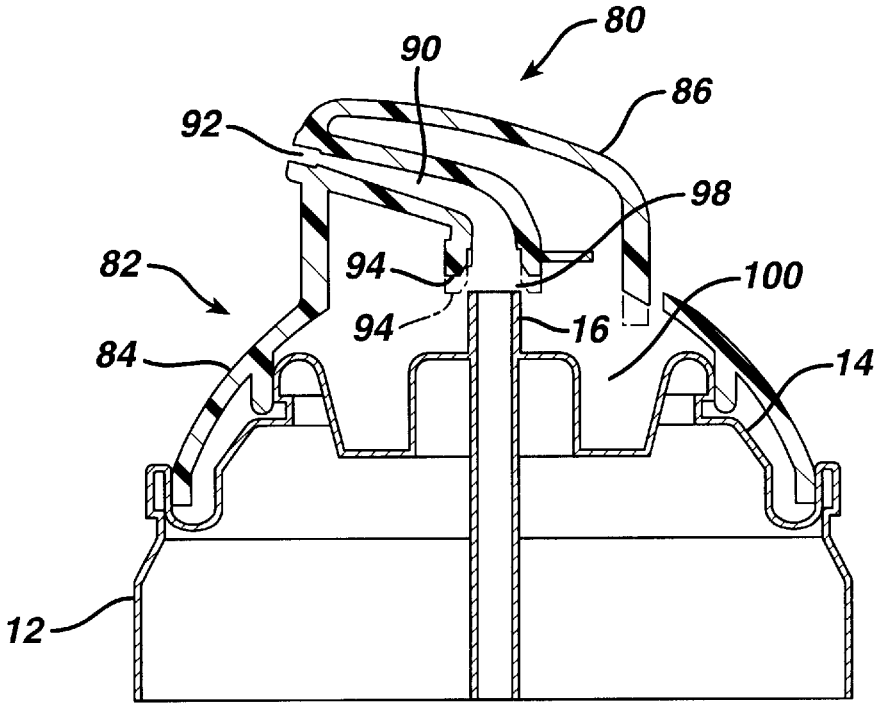
FIG. 10 is a partial vertical sectional view of another embodiment of a dispenser for dispensing a foaming product in an inactive position.

Referring to FIGS. 10–11, dispenser 80 for a foaming product is shown in a closed, inactive position. Dispenser 80 includes a nozzle member 82 having a base portion 84 that snap fits to the top 14 of can 12 and a movable portion 86 that is connected to base portion 84 by integral hinge 88 as is shown in FIG. 11. Integral hinge 88 is flexible and tends to bias movable portion 86 to the inactive position shown in solid lines FIG. 10. (Portions of movable portion 86 are shown in phantom for a depressed, discharge position.) Movable portion 86 includes a flow passage 90 for directing foaming product from the top of valve stem 16 to discharge outlet 92. Flow passage 90 has nozzle inlet 94 that is shaped to provide a sealable connection to the top of valve stem 16 when movable portion 86 is depressed. Flow passage 90 has a reduction in cross-sectional area in going from nozzle inlet 94 to discharge outlet 92 in order to provide a flow restriction.

In use, when the user depresses movable portion 86, nozzle inlet 94 moves downward with respect to the top of valve stem 16 and creates a seal therewith. Further depression of stem 16 causes foaming product to be discharged from can 12 through valve stem 16 and flow passage 90 to discharge outlet 92. In the discharge position, the foaming product has sufficient pressure to overcome the flow restriction in the flow passage 90 and can discharge out of outlet 92. When the user releases movable portion 86, the spring nature of integral hinge 88 causes movable portion 86 to return to the upright, inactive position. In this position, a gap 98 is created between nozzle inlet 94 and the top of stem 16, permitting foaming product to enter waste product containment region 100 located within nozzle member 82 and above the top 14 of can 12. In this position, the flow path through gap 98 has a flow resistance that is less than the flow restriction provided by the decreasing cross-section of flow passage 90, thereby directing undischarged foaming product to waste product containment region 100.

Referring to FIGS. 12 and 13, there is shown dispenser 110 for a foaming product including a nozzle member 112 that is similar to nozzle member 82 of FIG. 10 except that it includes a flow passage 114 of uniform cross-section (which improves the manufacturability), and includes an insert 116 at discharge outlet 118 in order to provide a flow restriction. As shown in FIG. 13, insert 116 includes a central member 120, which reduces the cross-section of the passage at the outlet end in order to provide the flow restriction.

Figure 15:
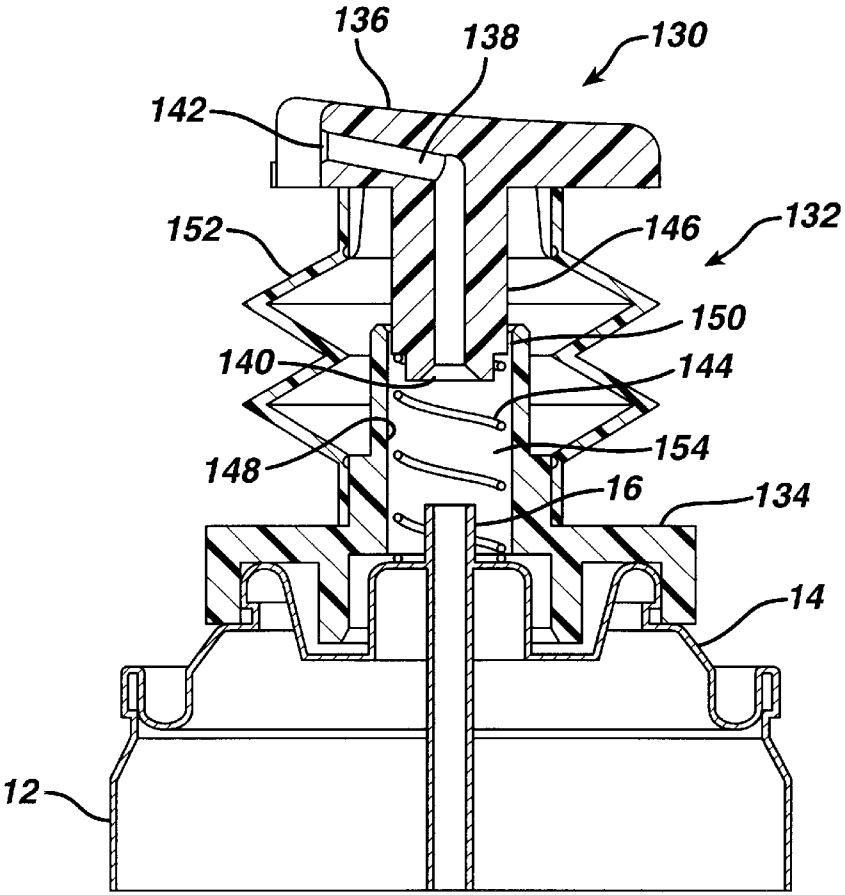
FIG. 15 is a partial vertical sectional view of the FIG. 14 dispenser in the inactive position.
Figure 14:
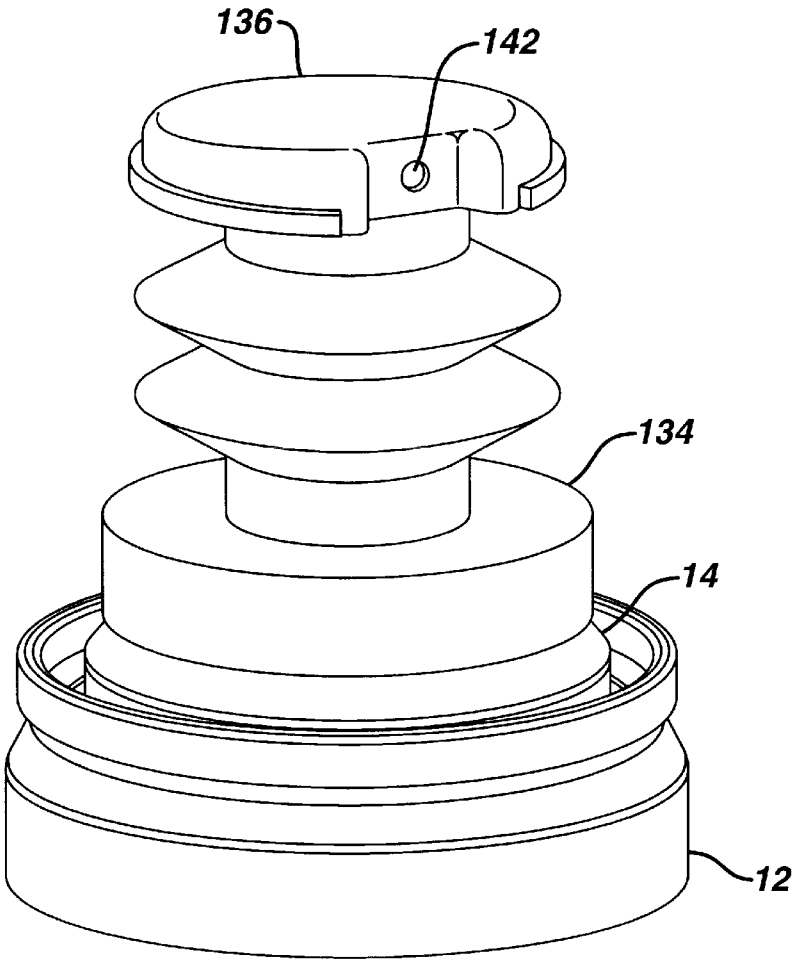
FIG. 14 is a partial perspective view of another embodiment of a dispenser for dispensing a foaming product in an inactive position.

Referring to FIGS. 14 and 15, dispenser 130 for a foaming product is shown in a closed inactive position. Dispenser 130 includes nozzle member 132 that has a base portion 134 that snap fits to the top 14 of can 12 and a movable portion 136. Movable portion 136 includes flow passage 138 extending from nozzle inlet 140 to discharge outlet 142. Nozzle inlet 140 is shaped to provide a sealable connection to the top of movable valve stem 16. Movable portion 136 is biased to the upward inactive position shown in FIG. 15 by spring 144. Movable portion 136 has a lower cylindrical portion 146 that slides within cylindrical chamber 148 extending upward from base portion 134.

The tolerances for the dimensions of the outer surface of portion 146 and the walls defining chamber 148 provide a small gap 150. Movable portion 136 is also connected by elastomeric bellows 152 to base portion 134.

In use, when the user depresses movable portion 136, nozzle inlet 140 makes a sealable connection to the top of valve stem 16 and depresses it downward, activating the valve and causing foam product to discharge through valve stem 16 and flow passage 138 to discharge outlet 142. When the user releases movable portion 136, spring 144 causes movable portion 136 to move upward, thereby increasing the volume in a waste containment region 154 and in the volume within bellows 152. The increase in volume in the region 154 and within the bellows 152 causes a decrease in pressure in waste containment region 154 such that is less than ambient pressure. This causes flow of waste product from flow passage 138 into waste containment region 154.

Other embodiments of the invention are within the scope of the appended claims.

What is claimed is:

1. A dispenser for dispensing a foaming product comprising a container containing said foaming product and having a top, a valve stem extending from said top of said container, said valve stem being movable downward to permit discharge of said foaming product from said container through said stem, said valve stem including a top end at said top of said container, a nozzle member including a movable portion that is movably connected to said top of said container, said nozzle member including a flow passage for directing said foaming product from said top of said valve stem through a nozzle inlet of said nozzle member to a discharge outlet of said nozzle member, and a waste product containment region located above said top of said container, said movable portion of said nozzle member being movable between a discharge position and an inactive position, wherein when said movable portion is in said discharge position, said valve stem is actuated to permit discharge of product into said flow passage and out of said discharge outlet, and said flow passage does not communicate with said containment region, and wherein when said movable portion is in said inactive position, said valve stem is not actuated and said flow passage communicates with said waste product containment region such that undischarged foaming product in said flow passage is directed to said waste product containment region, wherein said movable member includes first and second moving portions, said first moving portion having said flow passage therethrough and said discharge outlet thereon, said second moving portion being movably mounted with respect to said first portion such that said second portion closes said discharge outlet when said movable portion is in said inactive position, and opens said discharge outlet when said movable portion is in said discharge position, wherein said first moving portion is spring biased with respect to said second moving portion to a position in which said discharge outlet is closed, wherein said nozzle member has a base portion and wherein said first moving portion is connected to said base portion by an integral hinge.

2. A dispenser for dispensing a foaming product comprising a container containing said foaming product and having a top, a valve stem extending from said top of said container, said valve stem being movable downward to permit discharge of said foaming product from said container through said stem, said valve stem including a top end at said top of said container, a nozzle member including a movable portion that is movably connected to said top of said container, said nozzle member including a flow passage for directing said foaming product from said top of said valve stem through a nozzle inlet of said nozzle member to a discharge outlet of said nozzle member, and a waste product containment region located above said top of said container, said movable portion of said nozzle member being movable between a discharge position and an inactive position, wherein when said movable portion is in said discharge position, said valve stem is actuated to permit discharge of product into said flow passage and out of said discharge outlet, and said flow passage does not communicate with said containment region, and wherein when said movable portion is in said inactive position, said valve stem is not actuated and said flow passage communicates with said waste product containment region such that undischarged foaming product in said flow passage is directed to said waste product containment region, wherein said flow passage includes a flow restriction, said foaming product overcoming said restriction when said valve is in said discharge position, and further comprising a waste flow diverter path from said flow passage to said waste product containment region when said movable portion of said nozzle member is in said inactive position, said waste flow diverter path having less flow resistance than said flow restriction when said movable portion of said nozzle member is in said inactive position so as to direct said undischarged foaming product to said waste product containment region, said waste product not overcoming said flow restriction when said movable portion is in said inactive position, wherein said waste flow diverter path is provided by a gap between said nozzle inlet and said top end of said valve stem when said movable portion of said nozzle member is in said inactive position, said nozzle inlet contacting said top end of said valve stem when said movable portion of said nozzle member is in said discharge position, wherein said movable portion is spring-biased to said inactive position, wherein said nozzle member has a base portion that is connected to said container, and said movable portion is connected to said base portion by an integrally formed hinge between said base portion and said movable portion, said hinge providing said spring-bias to bias said movable portion to said inactive position.

3. The dispenser of claim 2 wherein said flow restriction is provided by a reduction channel cross-sectional area of said flow passage in going from said nozzle inlet to said discharge outlet.

4. The dispenser of claim 2 wherein said flow restriction is provided by a restricted area in said flow passage at said discharge outlet.

5. The dispenser of claim 4 wherein said flow restriction is provided by an insert placed in said flow passage at said discharge outlet.

6. A dispenser for dispensing a foaming product comprising a container containing said foaming product and having a top, a valve stem extending from said top of said container, said valve stem being movable downward to permit discharge of said foaming product from said container through said stem, said valve stem including a top end at said top of said container, a nozzle member including a movable portion that is movably connected to said top of said container, said nozzle member including a flow passage for directing said foaming product from said top of said valve stem through a nozzle inlet of said nozzle member to a discharge outlet of said nozzle member, and a waste product containment region located above said top of said container, said movable portion of said nozzle member being movable between a discharge position and an inactive position, wherein when said movable portion is in said discharge position, said valve stem is actuated to permit discharge of product into said flow passage and out of said discharge outlet, and said flow passage does not communicate with said containment region, and wherein when said movable portion is in said inactive position, said valve stem is not actuated and said flow passage communicates with said waste product containment region such that undischarged foaming product in said flow passage is directed to said waste product containment region, wherein said waste product containment region communicates with a chamber having a variable size, said chamber being operably connected to said nozzle member to have a decreased volume when said movable portion of said nozzle member is in said discharge position and an increased volume when said movable portion of said nozzle member is in said inactive position, and whereby decrease in pressure in said chamber to a pressure less than ambient pressure resulting from chamber expansion is communicated to said flow passage to cause flow of said waste product away from said discharge outlet and toward said waste product containment region after said valve has closed and said movable portion of said nozzle member has moved to said inactive position, wherein said nozzle member includes a guide member secured to said top of said container, and wherein said nozzle member has an extension that is telescoping with respect to said guide member as said movable portion of said nozzle member moves between said discharge position and said inactive position, said telescoping of said extension with respect to said guide member being maintained while in said inactive position and throughout movement of said movable portion from said inactive position to said discharge position.

7. The dispenser of claim 6 wherein said chamber includes a bellows.

8. The dispenser of claim 7 or 6 wherein said nozzle member includes a guide member secured to said top of said container, and wherein said nozzle member has an extension that is telescoping with respect to said guide member as said movable portion of said nozzle member moves between said discharge position and said inactive position, and wherein said guide member is spring biased to said inactive position.

9. The dispenser of claim 6 wherein said chamber is spring-biased to said expanded position.

10. The dispenser of claim 9 wherein said chamber includes a bellows, and said bellows provides said spring biasing.

11. A dispenser for dispensing a foaming product comprising a container containing said foaming product and having a top, a valve stem extending from said top of said container, said valve stem being movable downward to permit discharge of said foaming product from said container through said stem, said valve stem including a top end at said top of said container, a nozzle member including a movable portion that is movably connected to said top of said container, said nozzle member including a flow passage for directing said foaming product from said top of said valve stem through a nozzle inlet of said nozzle member to a discharge outlet of said nozzle member, and a waste product containment region located above said top of said container, said movable portion of said nozzle member being movable between a discharge position and an inactive position, wherein when said movable portion is in said discharge position, said valve stem is actuated to permit discharge of product into said flow passage and out of said discharge outlet, and said flow passage does not communicate with said containment region, and wherein when said movable portion is in said inactive position, said valve stem is not actuated and said flow passage communicates with said waste product containment region such that undischarged foaming product in said flow passage is directed to said waste product containment region, further comprising a discharge shut-off structure that provides a waste flow path from said discharge outlet to said waste product containment region when said movable portion of said nozzle member is in said inactive position and permits said discharge outlet to discharge said foaming product when said movable portion of said nozzle member is in said discharge position, wherein said shut-off structure is stationary with respect to said container, and movement of said movable portion of said nozzle member from said discharge position to said inactive position causes said discharge outlet to be moved from a position outside of said waste flow path to a position where it communicates with said waste flow path.

12. The dispenser of claim 11 wherein said container is pressurized can.

13. The dispenser of claim 11 wherein said containment region is a substantially enclosed chamber.

14. The dispenser of claim 11 wherein said movable portion of said nozzle member is pivotally connected to said shut-off structure.

15. The dispenser of claim 11 wherein said discharge shut off structure wipes the discharge outlet as the movable portion moves from said inactive position to said discharge position.

16. The dispenser of claim 11 wherein said nozzle member has a base portion that is connected to said container, and said movable portion is pivotally connected to said base portion.

17. The dispenser of claim 16 wherein said waste containment region is located within said base portion underneath said movable portion.

* * * * *